United States Patent [19]

Pool

[11] Patent Number: 4,625,812

[45] Date of Patent: Dec. 2, 1986

[54] PNEUMATIC IMPACT HAMMER

[75] Inventor: James L. Pool, Clarinda, Iowa

[73] Assignee: Lisle Corporation, Clarinda, Iowa

[21] Appl. No.: 718,520

[22] Filed: Apr. 1, 1985

[51] Int. Cl.[4] ..... B21J 15/22

[52] U.S. Cl. ..... 173/134; 173/128

[58] Field of Search ..... 173/12, 112, 113, 128, 173/134–138; 123/198 D

[56] References Cited

U.S. PATENT DOCUMENTS

| | | | |
|---|---|---|---|
| 2,100,541 | 11/1937 | Gartin | 173/134 X |
| 2,334,403 | 11/1943 | Forss | 173/134 X |
| 3,223,181 | 12/1965 | Price | 173/134 X |
| 3,815,367 | 6/1974 | Collins et al. | 61/1 |
| 3,851,713 | 12/1974 | Fedosenko et al. | 173/134 X |

OTHER PUBLICATIONS

California Tool Co. catalog, section 59, p. 512.

*Primary Examiner*—James M. Meister
*Assistant Examiner*—John L. Knoble
*Attorney, Agent, or Firm*—Allegretti, Newitt, Witcoff & McAndrews, Ltd.

[57] ABSTRACT

Pneumatic impact hammer for driving a frost plug into an engine block. The hammer includes a port for interconnection to a supply of compressed air, a chamber, a trigger, an elongate tube, a mallet slidably mounted within the tube, and a driver extending from one end of the tube. Compressed air is received by the chamber. Upon depressing the trigger, the compressed air within the chamber is substantially instantaneously applied to the back of the mallet. Consequently, the mallet is driven down the length of the tube toward the driver. The mallet impacts against the driver which, in turn, drives the frost plug into the engine.

10 Claims, 6 Drawing Figures

PNEUMATIC IMPACT HAMMER

BACKGROUND OF THE INVENTION

The present invention relates generally to an impact tool and more particularly to a pneumatic impact hammer for driving frost plugs into the block of an automotive engine. The blocks of most automotive engines include chambers for circulating a liquid coolant. If an engine is exposed to cold temperatures, any water within the chambers of the engine block will expand as it begins to freeze.

To release the pressure caused by the expanding water and thus prevent the block from cracking, the walls of many such engines include holes. In normal operation, these holes are blocked by "frost" or "expansion" plugs. The plugs normally act as part of the wall of the engine, maintaining the water within the proper chambers. If the water begins to freeze and expand, however, the water will force one or more of the frost plugs out of their holes. As a result, the pressure within the chambers of the engine block is often decreased to the point where the freezing water will not crack the block.

Frequently, the frost plugs in an automotive engine must be replaced. As discussed above, the frost plugs may be forced out by freezing water within the engine block. Even more commonly, the frost plugs corrode and no longer keep the coolant within the engine block.

Frost plugs are normally friction-fit into the holes of the engine walls. Since frost plugs normally function as part of the wall of the engine, the frost plugs must be tightly fitting within their respective holes of the engine wall.

Unfortunately, the presently available tools are poorly suited to meet the needs of a mechanic attempting to reinsert a frost plug into an automotive engine while the engine is in the vehicle. Typically, there is very little free space around the engine block. In addition, a substantial amount of force must be applied to the frost plug to insert it into the hole in the wall of the engine. Quite often, there is not enough room around the engine block for a mechanic to effectively swing a hammer and drive the frost plug into the engine. Consequently, a mechanic often must remove the engine from the vehicle so that there is enough space around the engine such that he may swing a hammer and pound the frost plug into place.

Other mechanical devices that may be available are inefficient in delivering force to the frost plug to safely and quickly drive the frost plug into the engine. In addition, many of such tools require manual power to drive the frost plug, rather than using a pneumatic source of power, which is commonly available to an automotive mechanic. Consequently, replacing a frost plug becomes a tiring and time consuming process.

SUMMARY OF THE INVENTION

In a principal aspect, the present invention is an impact hammer. The hammer includes a port for interconnecting the tool with a supply of compressed air and a chamber for receiving the compressed air from the port. The hammer further includes a trigger, a mallet which slides within an elongate tube, and a driver.

The trigger may be depressed by a mechanic in order to release air from the chamber, quickly delivering compressed air from the chamber against the mallet. The mallet consequently slides down the length of the tube and impacts the driver extending from the tube. The driver, upon receiving the impact from the mallet, slides outwardly against the frost plug.

In another principal aspect, the tube of the present invention includes both an outer tube to be held by the mechanic and an inner tube in which the mallet slides. The space between the outer and inner tubes defines the chamber in which compressed air is stored. This compressed air in the chamber is eventually allowed to press against the mallet and drive it down the inner tube toward the driver.

In addition, the hammer may include an output chamber, interconnecting the port and the region which is external to the tool itself. The output chamber includes a venturi substantially adjacent to the inside of the inner tube. After the mallet has been driven down the length of the inner tube, the air passes from the air supply, through the venturi, and out of the hammer. The venturi effect decreases the pressure of the air within the inner tube, causing the mallet to return to its original position. Thereafter, the air pressure may again be built up in the chamber between the outer and inner tubes.

An object of the present invention is an improved impact hammer. Another object is a pneumatic impact hammer that may be used to more easily drive a frost plug into the wall of an automotive engine while the engine is still within the vehicle. Still another object is an improved pneumatic hammer which may deliver a large force against the frost plug so that it may be more quickly driven into the engine.

Still another object is an impact hammer that more efficiently uses a source of non-manual power for operation. In addition, an object is a pneumatic impact hammer that more quickly provides repeated blows to force a frost plug into an engine.

Another object is an impact hammer that will more easily accommodate many different types of frost plug configurations. Yet a further object is a reliable tool that is more compact, light weight, and easy to use. These and other objects, features, and advantages of the present invention are discussed or apparent in the following detailed description.

BRIEF DESCRIPTION OF THE DRAWING

A preferred embodiment of the present invention is described herein with reference to the drawing wherein.

DETAILED DESCRIPTION OF A PREFERRED EMBODIMENT

Figure 1:
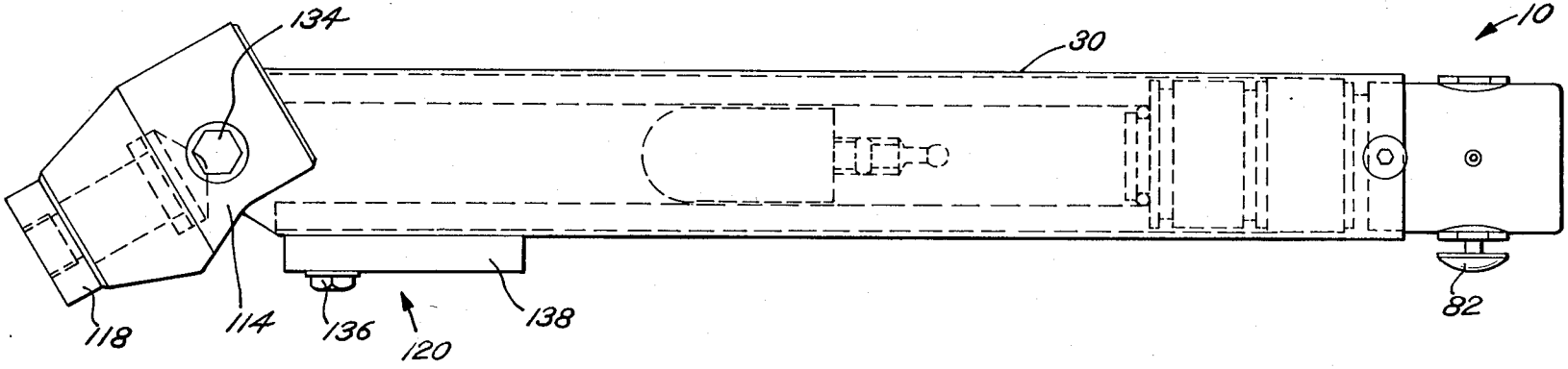
FIG. 1 is a side view of a preferred embodiment of the present invention.

Referring to FIGS. 1–6, the preferred embodiment of the present invention is shown as an improved pneumatic impact hammer, generally designated 10, for driving a frost plug into an engine block (not shown). The hammer 10 includes a control end 12, mid-region 14, driving end 16, and a mallet assembly 18.

Figure 2:
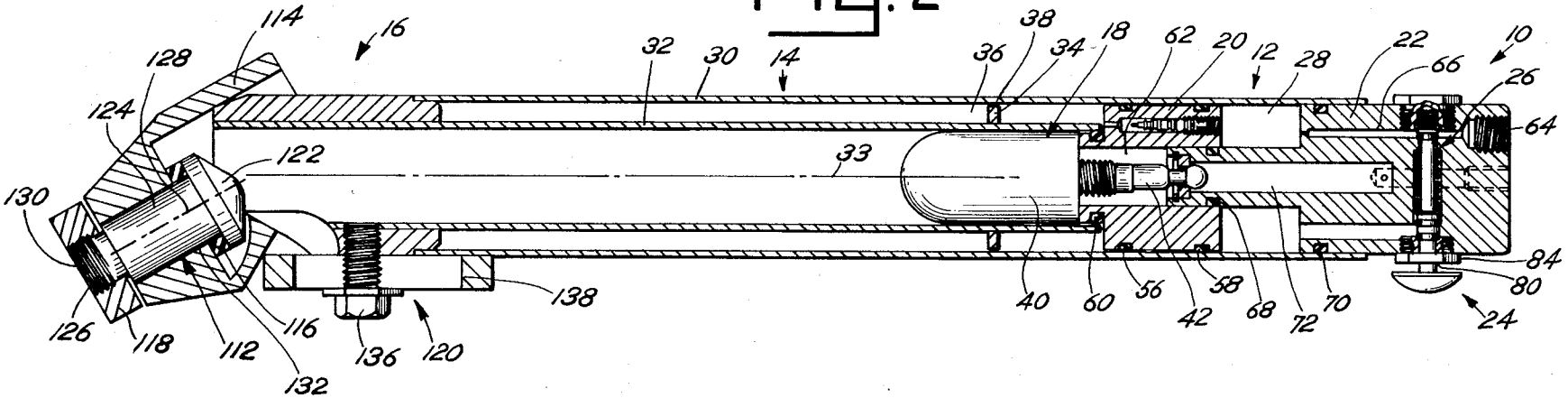
FIG. 2 is a cross-sectional view of the preferred embodiment shown in FIG. 1 showing the hammer in the loaded position.

The control end 12 includes a dump valve 20, control assembly 22, trigger assembly 24, and output chamber 26. When the tool 10 is in the loaded position, as shown in FIG. 2, the control assembly 22 and dump valve 20 are spaced apart and define a first chamber 28 between them.

The mid-region 14 includes both an outer tube 30 and an inner tube 32, as well as internal struts 34. The outer tube 30 is comprised of welded DOM steel tubing and interconnects the control and driving ends 12, 16 of the hammer 10. The outer tube 30 is substantially cylindrically-shaped, with a wall thickness of approximately 0.065 inch and an inside diameter of approximately 1.6 inches.

The inner tube 32 has a wall thickness of approximately 0.09 inch and an inside diameter of approximately 1 inch. The outer and inner tubes 30, 32 thus substantially define coaxial cylinders having a longitudinal axis designated as 33 in FIG. 2. Because the outside diameter of the inner tube 32 is substantially less than the inside diameter of the outer tube 30, a second chamber 36 is formed between the outer and inner tubes 30, 32.

The internal struts 34 lie within the second chamber 36 and structually support the outer and inner tubes 30, 32. Nonetheless, the struts 34 include passageways 38 to allow air to freely pass by and completely fill the second chamber 36.

Figure 3:
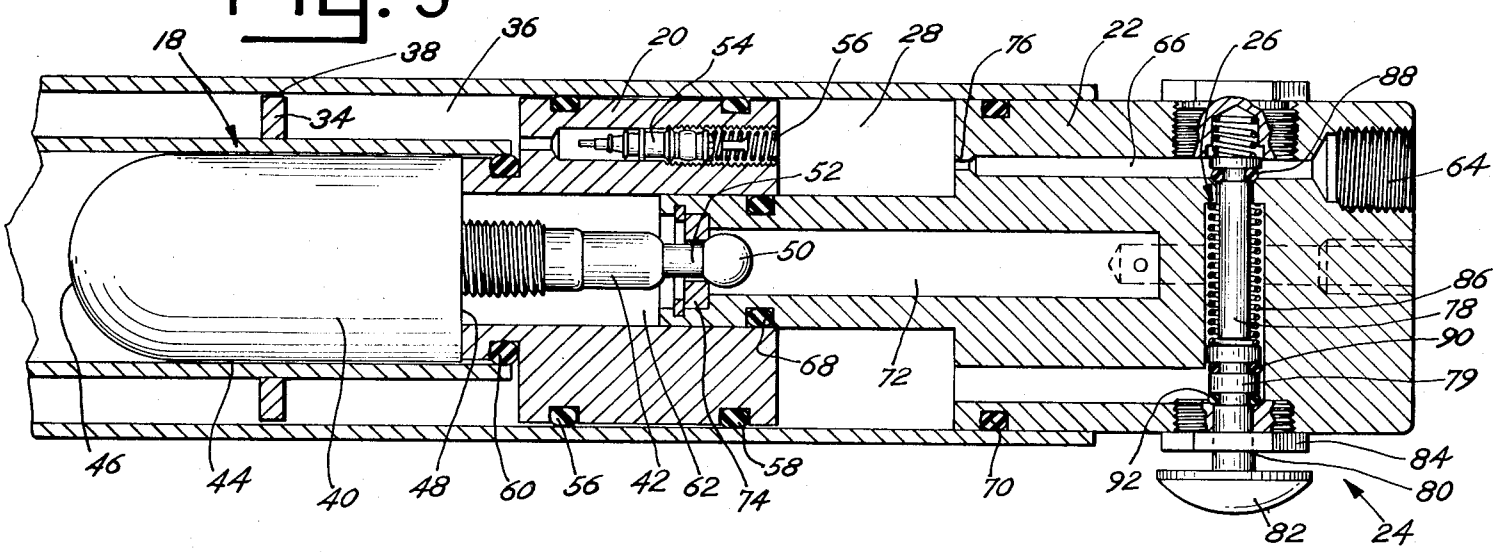
FIG. 3 is an enlarged cross-sectional view of the control end of the preferred embodiment shown in FIG. 2.
Figure 5:
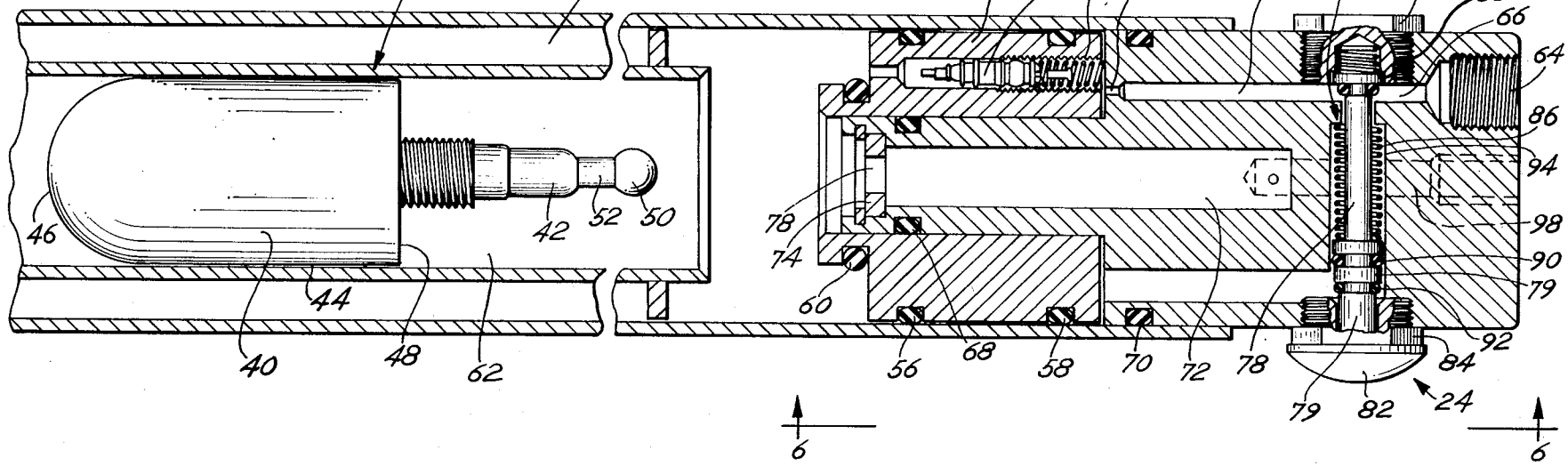
FIG. 5 is a cross-sectional view of the control end of the preferred embodiment shown in FIG. 1 showing the hammer in the reloading position.

As shown in FIGS. 2, 3, and 5, the mallet assembly 18 includes a mallet 40 and stem 42. The mallet 40 should weigh at least several ounces. In the preferred embodiment, the mallet 40 is made of tool steel and weighs approximately one-half pound. In addition, the mallet 40 defines a side wall 44 which is substantially adjacent the inner tube 32 as well as a driving end 46 and pressure end 48.

The driving end 46 of the mallet 40 is shaped substantially like a hemisphere having a radius of 0.5 inch. When properly placed within the hammer 10, the driving end 46 of the mallet 40 is proximate the driving end 16 of the hammer 10. The pressure end 48 of the mallet 40 is proximate the control end 12 of the hammer 10 and is substantially a flat surface.

The stem 42 screws into the mallet 40 and extends from the pressure end 48 approximately 1 inch. As shown in FIG. 5, one end of the stem 42 substantially defines a ball 50, with a diameter of about 0.23 inch, and a neck 52, with a diameter of about 0.18 inch.

As indicated previously, the control end includes a dump valve 20 and a control assembly 22. A shown in FIGS. 2 and 3, the dump valve 20 separates the first chamber 28 from the second chamber 36. The dump valve 20 includes a check valve 54, check spring 55, and O-rings 56, 58, 60. The check valve 54 allows air to pass from the first chamber 28 to the second chamber 36, but does not allow air to flow in the reverse direction.

The O-rings 56, 58 ensure that the dump valve 20 keeps the first and second chambers 28, 36, substantially isolated from each other, except for the passage of air through the check valve 54. The pressure end 48 of the mallet 40 and the dump valve 20 cooperatively define the internal chamber 62. When the dump valve 20 is in the loaded position (as shown in FIG. 2) the O-ring 60 isolates the second chamber 36 from the inside of the inner tube 32.

The control assembly 22 is made of aluminum and includes a port 64 and supply tube 66. As shown in FIG. 3, the control assembly further includes O-rings 68, 70, an internal passageway 72, and a flexible ring 74. The port 64 is threaded to receive a fitting, which may be interconnected to a pneumatic air line, which, in turn, is connected to a supply of compressed air (not shown). Typically, such a supply of compressed air is readily available to a mechanic working in an automotive garage.

Applicant has found that the present invention will work well with a supply of compressed air having a pressure of between 80 and 150 pounds per square inch. As expected, however, the greater the pressure of the air supply, the faster the hammer 10 operates and the more force that is applied by the hammer 10 to the frost plug.

As shown in FIGS. 2 and 3, the supply tube 66 interconnects the port 64 with the first chamber 28. Throughout most of its length, the supply tube 66 substantially defines a cylinder with a diameter of approximately 0.125 inch. However, the supply tube 66 also includes an orifice 76 having a diameter of only approximately 0.04 inch. The orifice 76 accordingly limits the volume of air that may be supplied to the first chamber 28 over a given period of time.

The flexible ring 74 is made of polyurethane and is fixedly attached to the control assembly 22. The flexible ring 74 defines an aperture 78 that has an unflexed inside diameter of approximately 0.2 inch. However, the aperture 78 may be expand to receive the 0.23 inch diameter ball 50 on the stem 42 as well as the smaller neck 52 of the stem 42. Accordingly, as shown in FIGS. 2 and 3, when the mallet 40 is in the loaded position, the ball 50 extends into the internal chamber 62 and the flexible ring 74 encompasses the neck 52 of the stem 42.

When the hammer 10 is in the loaded position, as shown in FIG. 2, the O-ring 68 substantially isolates the air in the second chamber 36 from the internal passageway 72. The O-ring 70 extends around the control assembly 22 to ensure that the first chamber 28 is isolated from the region exterior to the hammer 10.

The trigger assembly 24 includes two elongate rods 78, 79. The rod 79 extends into a trigger opening 80 within the control assembly 22. The trigger assembly 24 also includes a rounded head 82 extending outside of the control assembly 22, a brass nut 84, a check spring 86, an input O-ring and seat 88, and first and second output O-rings and seats 90, 92. The trigger assembly 24 defines loaded, driving, and reloading positions.

The brass nut 84 holds the trigger assembly 24 within the control assembly 22. When in loaded, or relaxed, position shown in FIGS. 2 and 3, the check spring 86 holds the trigger assembly 24 in position. The input O-ring 88 isolates the supply tube 66 from the output chamber 26. The first output ring 90 similarly isolates the output chamber 26 from the first chamber 28, and the second output O-ring 92 isolates the first chamber 28 from the region external to the hammer 10.

Importantly, the O-ring 88 never interferes with the supply of air to the first chamber 28. Throughout the operation of the hammer 10, air is always available through the orifice 76 at the line pressure, regardless of what position the trigger assembly 24 is in.

Figure 4:
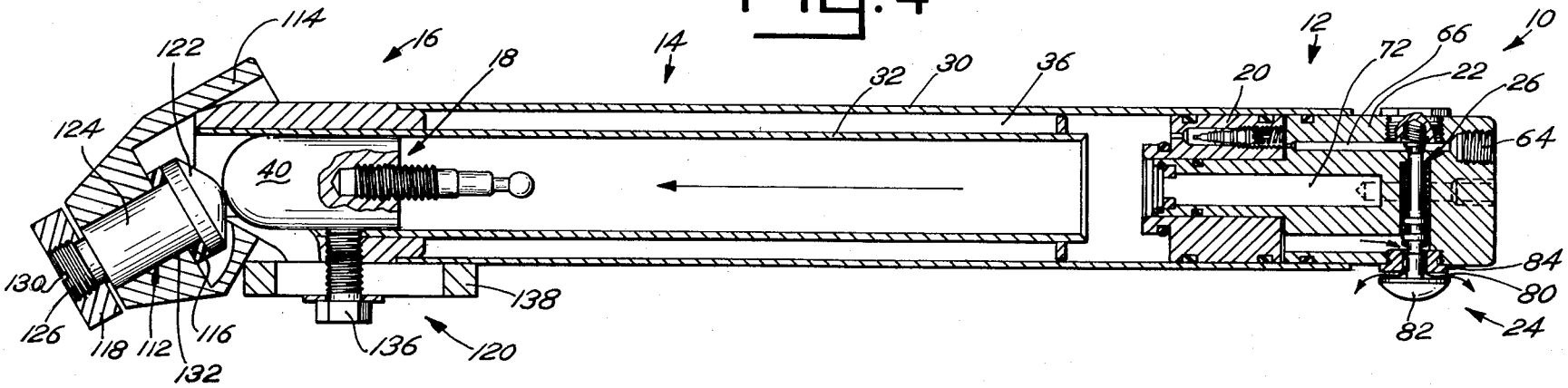
FIG. 4 is a cross-sectional view of the preferred embodiment shown in FIG. 1 showing the hammer in the driving position.

When the rounded head 82 is depressed by a mechanic, the check spring 86 compresses somewhat, and the trigger assembly 24 assumes the driving position shown in FIG. 4. The input and first output O-rings 88, 90 still prevent air in the passage 66 from reaching the output chamber 26. However, the second output O-ring 92 no longer separates the first chamber 28 from the external region. Consequently, the compressed air in the first chamber 28 escapes via the trigger opening 80, and the pressure of the air within the first chamber 28 decreases. The dump valve 20 then opens (moving to the right of the position shown in FIG. 2), letting air out of the chamber 36 to move the mallet 40. When the rounded head 82 is further depressed, the check spring 86 further depresses, and the rod 78 pushes against the rod 79. Consequently, the input O-ring 88 no longer blocks air in the supply tube 66 from reaching the output chamber 26.

Figure 6:
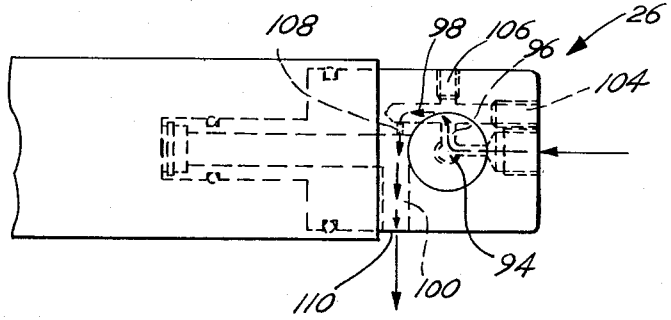
FIG. 6 is a cross-sectional view of the control section of the preferred embodiment shown in FIG. 5 (taken substantially along the line 6—6, showing the hammer rotated 90° C. from its position in FIG. 5 in order to more clearly demonstrate the venturi assembly).

As shown in FIGS. 5 and 6, the output chamber 26 includes first, second, third, and fourth passageways 94, 96, 98, 100, first, second, and third plugs 102, 104, 106, a venturi 108, and an output port 110. The first passageway 94, which surrounds the elongate rod 78 of the trigger assembly 24, is covered with the threaded plug 102. The second and third passageways 96, 98 have been drilled into the control assembly 22 and covered with the permanent plugs 104, 106.

When the trigger assembly 24 assumes the reloading position, compressed air may travel from the supply tube 66, down the first passageway 94, along the check spring 86. From the first passageway 94, the air travels through the second and third passageways 96, 98, the venturi 108, the fourth passageway 100, and the output port 110. The output port 110 is substantially circular, with a diameter of approximately 0.3 inch.

The venturi 108 is also substantially circular, with a diameter of approximately 0.055 inch, substantially smaller than the first, second, third or fourth passageways 94–100. Thus, air flows relatively rapidly into the fourth passageway 100. Moreover, the fourth passageway 100 is positioned substantially adjacent the internal passageway 72 and the inside of the inner tube 32, resulting in a vacuum within the inner tube 32.

The driving end 16 of the hammer 10 includes a slidable driver 112, pivoting head assembly 114, shock absorber 116, adapter 118, and bumper assembly 120. The driver 112 includes a substantially conical head 122, a smooth central portion 124, and a threaded external end 126.

The shock absorber 116 is substantially washer-shaped and made of polyurethane. The shock absorber 116 rests between the head 122 of the driver 112 and the pivoting head assembly 114. The central portion 124 of the driver 112 is substantially cylindrical and defines a central axis 128 therethrough. The external end 126 of the driver 112 also includes a slot 130 to receive a screwdriver (not shown).

The pivoting head assembly 114 includes a cylindrical aperture 132, to slidably hold the driver 112, and a bolt 134 (FIG. 1). The bolt 134 hingedly interconnects the rest of the pivoting head assembly 114 to the hammer 10 such that the axis 128 of the driver 112 may be swiveled to be either aligned with the axis 33 of the outer and inner tubes 30, 32 or at an angle of 90° from it.

The adapter 118 is made of 4140 alloy steel and is screwed on to the threaded external end 126 of the driver 112. The adapter 118 may be of varying sizes, so that a frost plug will gently slide about it. With a screwdriver inserted in the slot 130 of the driver 112, the adapter 118 may be screwed onto the driver 112, and the screwdriver used to keep the driver 112 from rotating.

The bumper assembly 120 includes a bolt 136 and a slotted bar 138. The pivoting head assembly 114 is first rotated to a proper angle with respect to the axis 33. The slotted bar 138 may then be slid laterally against the pivoting head assembly 114 and the bolt 136 tightened, thus maintaining the pivoting head assembly 114 in a desired angular position.

The operation of the hammer 10 is as follows. First, the proper size adapter 118 is screwed onto the driver 112. The adapter 118, with the frost plug placed about it, is then lined up with the proper hole in the wall of the engine block.

Initially, the trigger assembly 24 is in the loaded position, as shown in FIG. 2, and the port 64 receives compressed air. The air flows through the supply tube 66 and orifice 76, into the first chamber 28. The air also flows through the check valve 54 and into the second chamber 36.

The surface area of the dump valve 20 adjacent the first chamber 28 is larger than the surface area of the dump valve 20 adjacent the second chamber 36. Consequently, with line pressure applied to the port 64, the dump valve remains in (or moves to) the position shown in FIG. 2. The pressure in the second chamber 36 substantially equals the line pressure, less the pressure of the check spring 55 (approximately 3 or 4 pounds).

Thus, the pressure in both the first and second chambers 28, 36 is approximately the pressure of the external source of pressurized air (line pressure). However, because the O-ring 60 isolates the internal chamber 62 from the second chamber 38, the pressure in the internal chamber 62 is approximately at atmospheric pressure.

When the rounded head 82 of the trigger assembly 24 is partially pressed, it assumes the driving position shown in FIG. 4. Air flows out of the second chamber 36, through the trigger opening 80, out of the region external to the hammer 10. The trigger opening 80 defines a cross sectional area that is larger than the area of the orifice 76. In the preferred embodiment, the area of the trigger opening 80 is over three times larger than the area of the orifice 76. Thus, substantially more air leaves the first chamber 28 than is replenished by the external air supply. Consequently, there is a loss of air pressure in the first chamber 28. Accordingly, the dump valve 20 opens, sliding (to the "right" of the position depicted in FIG. 2) to the firing position shown in FIG. 4.

As soon as the dump valve 20 slides toward the firing position shown in FIG. 4, all of the pressure built up in the second chamber 36 is directly applied to the pressure end 48 of the mallet 40. The air pressure against the mallet 40 suddenly goes from a near atmospheric pressure to the line pressure. Accordingly, the mallet 40 is forced down quickly through the inner tube 32 toward the driving end 16 of the hammer 10 at a very high rate of speed.

The near instantaneous application of the high air pressure in the second chamber 36 accelerates the mallet 40 much faster than the direct application of air from an air line through a small valve. After being driven the length of the inner tube 32, the mallet 40 strikes the head 122 of the driver 112.

Since the input orifice 76 is smaller than the trigger opening, the pressure from the first chamber 28 against the dump valve 20 will be less than the pressure from the second chamber 36, and the dump valve 20 will remain in the position shown in FIG. 4. The mallet 40 hits the driver 112, forcing the driver 112 outward and the frost plug into the engine wall. The shock absorber 116 prevents the head 122 of the driver 112 from contacting the pivoting head assembly 114 and possibly causing damage when the two steel parts contact.

The rounded head 82 of the trigger assembly 24 is then depressed completely to the reloading position shown in FIG. 5. In this position, the input O-ring 88 no longer seals against the control assembly 22. Instead, as shown in FIGS. 5 and 6, air can flow from the supply tube 66, down alongside the spring 86 of the trigger assembly 24, and out of the control assembly 22.

As shown in FIG. 5, the escaping air passes through the venturi 108. The passing air creates a lower pressure in the region of the inner tube 32 that is adjacent the pressure side 48 of the mallet 40. The air pressure in the inner tube 32 becomes less than the atmospheric pressure, drawing the mallet 40 back toward the control assembly 22.

Eventually, the mallet 40 returns to the loaded position, driving the stem 42 through the flexible ring 74. The operator of the hammer 10 can then stop depressing the rounded head 82 of the trigger assembly 24 and allow it to resume the loaded, or relaxed, position. Subsequently, the O-rings 88–92 prevent further escape of air from the hammer 10.

Air pressure then builds up in the first chamber 28, causing the dump valve 20 to move forward, toward the driving end 16 of the hammer 10, and seal against the inner tube 32. Pressure then builds up in the second chamber 36 in preparation for again driving the mallet 40 down the inner tube 32.

The entire cycle time for the hammer 10 may be less than six seconds. The process of the mallet 40 releasing from the locked position, striking the driver 112, and returning to the loaded position takes only two to three seconds. In another two or three seconds, the first and second chambers 28, 36 may be repressurized to allow the cycle to begin again. Thus, in a matter of a few seconds, a frost plug can be repeatedly driven into the engine.

In the preferred embodiment, the hammer 40 is driven with air pressure. It may be possible, of course, to implement the present invention with other forms of energy. For example, it may be possible to construct the tool using hydraulic rather than pneumatic pressure.

A preferred embodiment of the present invention has been described herein. It is to be understood, however, that changes and modifications can be made without departing from the true scope and spirit of the present invention. This true scope and spirit are defined by the following claims and their equivalence, to be interpreted in light of the forgoing specification.

What is claimed is:

1. An impact hammer for use with a supply of compressed air comprising, in combination:

port means for interconnecting said hammer and supply of compressed air;

a first chamber, interconnected to said port means, for receiving said compressed air;

an elongate outer tube;

an elongate inner tube within said outer tube, said outer and inner tubes defining a second chamber therebetween, said outer and inner tubes also defining driving ends and control ends;

channel means between said first and second chambers for allowing said compressed air to flow from said first chamber to said second chamber;

a mallet slidably mounted within said inner tube, said mallet including a side wall substantially adjacent said inner tube, a driving end proximate said driving ends of said outer and inner tubes, and a pressure end proximate said control ends of said outer and inner tubes;

trigger means for releasing air from said first chamber;

driver means slideably extending from said driving end of said inner tube;

dump valve means for detecting a release of air from said first chamber and thereafter directing said compressed air from said second chamber against said pressure end of mallet, whereby said hammer may slide along said inner tube and impact said driver.

2. A pneumatic impact hammer for use with a supply of compressed air comprising, in combination:

port means for interconnecting said hammer and supply of compressed air;

a first chamber, interconnected to said port means, for receiving said compressed air;

an elongate outer tube;

an elongate inner tube within said outer tube, said inner and outer tubes defining a second chamber therebetween, said inner and outer tubes also defining driving ends and control ends;

a mallet slidably mounted within said inner tube, said hammer defining a side wall substantially adjacent said inner tube, a driving end proximate said driving ends of said outer and inner tubes, and a pressure end proximate said control ends of said outer and inner tubes;

a stem extending from said pressure end of said mallet;

retainer means, fixedly attached with said control end of said outer tube, for releasably clasping said stem;

an output chamber passing from said port through said control end of said outer tube and including a venturi substantially adjacent said control end of said inner tube;

driver means slideably extending from said driving ends of said inner and outer tubes;

dump valve means, slideably mounted within said control end of said outer tube, for detecting a decrease of air pressure within said first chamber and thereafter directing said compressed air from said second chamber against said pressure end of said mallet, whereby said stem separates from said retainer means and said mallet is driven along said inner tube to impact said driver; and depressable trigger means defining first, second, and third positions, said depressable trigger means allowing air to pass from said port means to said first and second chambers when in said first position, whereby said first and second chambers may be filled with said compressed air, said depressable trigger means releasing air from said first chamber when in said second position, whereby air pressure within said first chamber is reduced to activate said dump valve means and allow said mallet to be driven along said inner tube, and said depressable trigger means passing air from said port means through said venturi when in said third position, whereby air pressure in said inner tube is reduced and said mallet returns to position said stem within said retainer means.

3. A hammer as claimed in claim 2 wherein said outer and inner tubes substantially define coaxial cylinders.

4. A hammer as claimed in claim 2 further comprising a check valve, interconnecting said first and second chambers, for allowing air to pass only from said first chamber to said second chamber.

5. A hammer as claimed in claim 4 further comprising pivot head means, interconnected to said driving end of said outer tube, for holding said driver.

6. A hammer as claimed in claim 5 wherein said driver includes both a head within said inner tube and an external end extending from said hammer, said hammer further comprising and adaptor attached to said external end of said driver, whereby said adaptor may fit within a frost plug of an automotive engine.

7. A hammer as claimed in claim 4 wherein said driving side of said mallet substantially defines a hemisphere.

8. A hammer as claimed in claim 7 wherein said mallet is comprised of tool steel and weighs at least four ounces.

9. A hammer as claimed in claim 4 wherein said driver means includes a substantially conically shaped head within said inner tube.

10. A hammer as claimed in claim 9 further including a shock absorber interposed between said head of said driver means and said pivot head means.

* * * * *